United States Patent [19]

Meyer et al.

[11] 4,326,944

[45] Apr. 27, 1982

[54] RAPID HYDROPYROLYSIS OF CARBONACEOUS SOLIDS

[75] Inventors: James S. Meyer, Naperville; Ken K. Robinson, St. Charles; John M. Forgac, Elmhurst; David F. Tatterson, Downers Grove, all of Ill.

[73] Assignee: Standard Oil Company (Indiana), Chicago, Ill.

[21] Appl. No.: 140,171

[22] Filed: Apr. 14, 1980

[51] Int. Cl.[3] ..... C10G 1/06

[52] U.S. Cl. ..... 208/8 R; 208/11 R; 201/2.5; 201/36; 165/DIG. 5

[58] Field of Search ..... 208/8 R, 11 R; 201/2.5, 201/36

[56] References Cited

U.S. PATENT DOCUMENTS

| | | | |
|---|---|---|---|
| 1,713,794 | 5/1929 | Trumble | 208/11 R X |
| 2,435,746 | 2/1948 | Jones | 201/36 X |
| 2,832,545 | 4/1958 | Segraves | 208/127 |
| 3,960,700 | 6/1976 | Rosen et al. | 208/8 R |
| 3,997,423 | 12/1976 | Greene | 208/11 R X |
| 4,003,820 | 1/1977 | Pelofsky et al. | 208/11 R X |
| 4,012,311 | 3/1977 | Greene | 208/8 R |
| 4,013,543 | 3/1977 | Greene | 208/8 R X |
| 4,123,349 | 10/1978 | Wurfel | 208/10 |
| 4,169,128 | 9/1976 | Sinor et al. | 208/8 R X |

OTHER PUBLICATIONS

AVCO Everett Research Laboratory, Inc., Coal Gasification, Chem. from Coal, MHD Power Generation, Coal Feed Control, Coal Slag Technology, 2385 Revere Beach Parkway, Everett, Mass. 02149.

*Primary Examiner*—Delbert E. Gantz
*Assistant Examiner*—Olik Chaudhuri
*Attorney, Agent, or Firm*—James R. Henes; William T. McClain; William H. Magidson

[57] ABSTRACT

A method is disclosed for recovering liquids and gases by a rapid hydropyrolysis of carbonaceous solids which comprises subjecting the carbonaceous material in a stream of carrier gas to a first pressure and a first temperature below the decomposition temperature of the carbonaceous material; reducing substantially in a single step the pressure on the stream of carbonaceous material from the first pressure to a second pressure, the ratio of the first pressure to the second pressure being at least 1.6, thereby accelerating the carrier gas in the stream of carbonaceous material; permitting the accelerated stream of carbonaceous material to expand as a free jet and mixing hot gas with the accelerated and expanded stream of carbonaceous material to raise the temperature of the carbonaceous material by heat exchange with the hot gas, to a second temperature of at least the aforesaid decomposition temperature, thereby initiating decomposition of the carbonaceous material; and reducing the temperature of the reaction mixture to below said decomposition temperature, with the total time for heating the carbonaceous material from the first temperature to the second temperature, decomposing the carbonaceous material and cooling the reaction mixture to below said decomposition temperature being from about 1 millisecond to about 10 seconds.

22 Claims, 1 Drawing Figure

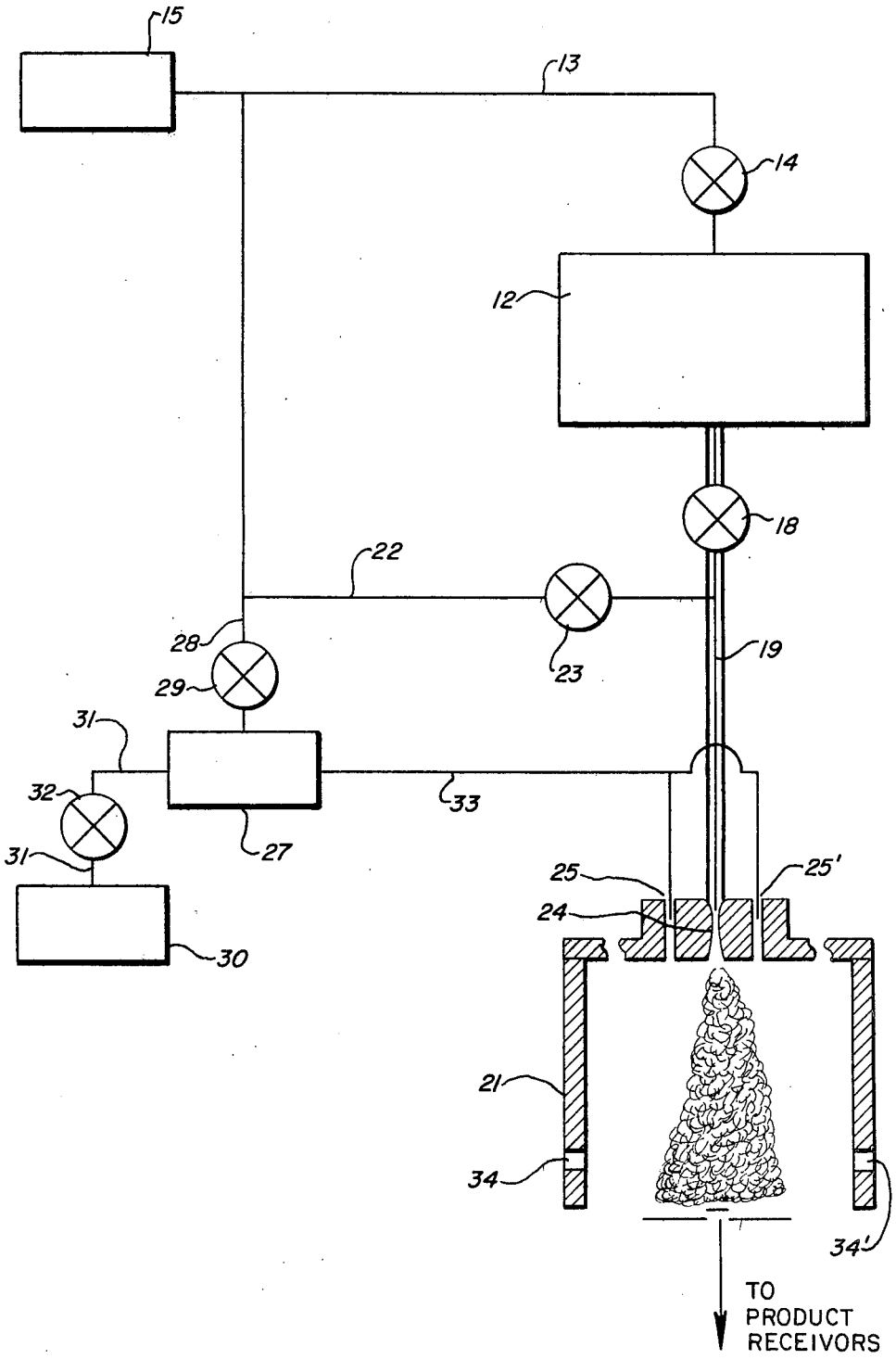
15
13
14
12
18
22
23
19
28
29
31
32
33
27
31
30
25
25'
24
21
34
34'
TO
PRODUCT
RECEIVORS

RAPID HYDROPYROLYSIS OF CARBONACEOUS SOLIDS

BACKGROUND OF THE INVENTION

1. Field of the Invention

This invention relates generally to the recovery of liquid and gaseous products from carbonaceous materials such as coal, char, tar sands, oil shale, uintaite and biomass and more particularly concerns the rapid and direct conversion of such carbonaceous materials involving hydropyrolysis in the gas phase.

2. Description of the Prior Art

Considerable evidence in the literature suggests that the products initially formed during the thermal decomposition of carbonaceous materials such as coal, char, tar sands, oil shale, uintaite and biomass are largely in the liquid molecular weight range and that they continue to decompose and recombine to form refractory products like coke and gas the longer they are subjected to the thermal decomposition conditions. The available evidence also indicates that the lifetime of these liquid products, under the conditions of thermal decomposition is short. Therefore, in order to maximize liquid yields from such decompositions, it is desirable to limit the time during which the products initially formed are subjected to the decomposition conditions. Thus a low residence time of the decomposition mixture in the decomposition zone and a high rate of decomposition therein are advantageous. Similarly, rapidly quenching the decomposition reaction at some optimum short time after the decomposition commences reduces undesirable secondary reactions.

Decomposition at low pressures also maximizes the yield of the desired hydrocarbon liquids and gases. The use of low decomposition pressures facilitates the escape of volatile products from the decomposing carbonaceous material and from one another and thus minimizes their tendency to recombine.

Furthermore, it is generally recognized that the conversion of carbonaceous materials, such as coal, char, tar sands, oil shale, uintaite and biomass, to the desired liquid and gaseous products can be maximized by stabilizing the liquid products initially formed. This is often effected by reaction of the liquid products with a stabilizing material such as hydrogen or with a source of such stabilizing material. It has been shown that at the beginning of the thermal decompositions of such carbonaceous materials a transient period exists during which the products initially formed are highly reactive toward a stabilizing material such as hydrogen. The overall effect of thermal decomposition in the presence of such a stabilizing material or a source thereof is a much larger yield of the desired liquids and a lower char yield. However, if excess stabilizing material is not readily available during this period, some of the free radical decomposition products will polymerize to form unreactive char, with the overall effect being a limited yield of the desired liquids and a large yield of char.

However, decomposition implies that chemical bonds are being broken inside the carbonaceous material where the products initially formed may be effectively insulated from the stabilizing material or a source thereof in the environment surrounding the carbonaceous material and thus are precluded from stabilization by reaction with the stabilizing material or a source thereof. Moreover, the available time to achieve such stabilization may be too short to rely on mass transfer of the stabilizing material or a source thereof solely by diffusion and convection. Decomposition at low pressures facilitates the escape of volatile products from the decomposing carbonaceous material and from each other and thereby enhances their accessibility to the surrounding environment of stabilizing material or a source thereof. Moreover, pretreatment to position the stabilizing material or source thereof in extremely close proximity to the carbonaceous material before decomposition commences minimizes the effects of such slow mass transfer.

Greene, U.S. Pat. Nos. 3,997,423; 4,012,311; 4,013,543; and 4,048,053; Rosen et al., 3,960,700; and Pelofsky et al., 4,003,820 disclose processes for recovering liquids from carbonaceous solids and lower boiling liquids from higher boiling liquid hydrocarbons, which do involve a rapid decomposition of the carbonaceous material in the presence of hydrogen and at a low pressure and a rapid quenching of the decomposition reaction.

In particular, Greene, U.S. Pat. Nos. 3,997,423 and 4,013,543 disclose a process of producing carbonaceous tars from liquid or crushed solid carbonaceous material comprising (1) introducing carbonaceous material into a reactor; (2) adding hot hydrogen to the carbonaceous material in the reactor; (3) reacting the hydrogen and carbonaceous material for a period of from about two milliseconds to about two seconds at a temperature of about 400° C. to 2,000° C. and at a pressure between atmospheric and 250 psia.; and (4) quenching the mixture within the reactor, with the total residence time for steps (2) and (3) varying from about two milliseconds to about two seconds. The patentee states that the heat-up rate of the carbonaceous material is in excess of 500° C. per second.

Greene, U.S. Pat. Nos. 4,012,311 and 4,048,053 discloses processes which are similar to the processes of Greene, U.S. Pat. Nos. 3,997,423 and 4,013,543, and in which the decomposition reaction takes place at a pressure between atmospheric and 450 psia.

Rosen et al., U.S. Pat. Nos. 3,960,700 and Pelofsky et al., 4,003,820 disclose processes which are similar to the processes of Greene, U.S. Pat. Nos. 3,997,423 and 4,013,543, and in which the decomposition reaction takes place at a higher pressure between 500 and 5,000 psig.

Although Pelofsky et al., U.S. Pat. No. 4,003,820 and Greene, U.S. Pat. Nos. 4,012,311 and 4,048,053 do disclose in general terms an additional step in which the carbonaceous material is pretreated with hydrogen prior to being decomposed, such patents do not disclose the conditions of such pretreatment.

Furthermore, none of Greene, U.S. Pat. Nos. 3,997,423; 4,012,311; 4,013,543; and 4,048,053; Rosen et al., U.S. Pat. No. 3,960,700; or Pelofsky et al., U.S. Pat. No. 4,003,820 disclose a suitable method for rapidly introducing the carbonaceous material into the reactor. These patents disclose only that, in order to overcome the reactor pressure, both the carbonaceous material and the incoming hydrogen must be fed into the reactor at a pressure exceeding that of the reactor. Rapid passage of the carbonaceous material into and through the reactor is essential if a short decomposition time and a commercially acceptable, high through-put of carbonaceous material is to be achieved.

One suitable method for rapidly introducing the carbonaceous material into the decomposition zone involves entraining the carbonaceous material in a stream of compressed gas and instantaneously expanding and accelerating this stream as it passes through a restricted area into the decomposition zone. A similar technique is employed in a method for disintegrating coal solids as disclosed in Yellott, U.S. Pat. No. 2,515,542. Such technique not only serves to introduce the carbonaceous material rapidly into the decomposition zone but also permits the volatile fragments and radicals which form in the interior of the carbonaceous material to move rapidly away from the carbonaceous material and from one another.

Avco Everett Research Laboratory, Inc. has in very general terms disclosed to various people in the industry a coal gasification technique utilizing a two-stage gasifier. In the first stage, char is burned with oxygen to generate heat. The combustion gases from this combustion are then fed to a pyrolyzer through a converging-diverging nozzle. A large pressure drop is maintained across the nozzle. The combustion gases are accelerated to sonic conditions in the converging section of the nozzle, resulting in a cooling of the gases. Coal and steam are fed or aspirated into the stream of combustion gases at or slightly upstream of the throat of the nozzle. The mixture is then accelerated to supersonic flow in the diverging section of the nozzle and discharges into the pyrolyzer as a confined jet. As the gas velocity decreases from supersonic flow to subsonic flow in the pyrolyzer, a shock occurs which results in rapid heating of the coal, leading to the rapid formation of volatile material in the coal. Many of the volatiles are believed to be free radicals which are stabilized by the steam, thus preventing soot formation. Argon, carbon monoxide, helium and nitrogen have also been studied as stabilization gases. The residence time of the reaction mixture in the pyrolyzer is about 40 milliseconds.

OBJECTS OF THE INVENTION

It is therefore a general object of the present invention to provide an improved method for recovering more valuable products from carbonaceous material which possesses the aforementioned desirable features and overcomes the shortcomings of prior art methods.

More particularly, it is an object of the present invention to provide a thermal decomposition method for recovering liquids and gases from solid carbonaceous material which maximizes the liquid yields by optimizing the time during which the carbonaceous material is subjected to thermal decomposition conditions.

Another object of the present invention is to provide a method for decomposing solid carbonaceous material which maximizes the liquid yields by facilitating the escape of volatile products from the carbonaceous material and from one another and thereby minimizes their tendency to recombine.

A further object of the present invention is to provide a method for decomposing solid carbonaceous materials which enhances the accessibility of the volatile products initially formed from the carbonaceous material to an environment of stabilizing material.

Other objects and advantages of the invention will become apparent upon reading the following detailed description and appended claims, and upon reference to the accompanying drawing.

SUMMARY OF THE INVENTION

These objects are achieved by an improved process for treating crushed solid carbonaceous material to obtain therefrom liquid and gaseous products, which comprises subjecting the carbonaceous material in a stream of carrier gas to a first pressure in the range of from about one atmosphere to about 680 atmospheres, at a first temperature of from about ambient up to the decomposition temperature of the carbonaceous material, the solid carbonaceous material having a particle size in the range of from about one micron up to about one millimeter in the largest dimension; reducing substantially in a single step the pressure on the stream of carbonaceous material from the first pressure to a second pressure in the range of from about sub-atmospheric to about 272 atmospheres, the ratio of the first pressure to the second pressure being at least 1.6, thereby accelerating the carrier gas in the stream of carbonaceous material; permitting the accelerated stream of carbonaceous material to expand as a free jet and mixing hot gas with the accelerated and expanded stream of carbonaceous material to raise the temperature of the carbonaceous material by heat exchange with the hot gas, to a second temperature in the range of said decomposition temperature to about 2,204° C., and thereby initiating decomposition of the carbonaceous material, to form a reaction mixture containing liquids and gases; and reducing the temperature of the reaction mixture to below said decomposition temperature, with the total time for heating the carbonaceous material from the first temperature to the second temperature, decomposing the carbonaceous material and cooling the reaction mixture to below said decomposition temperature being from about 1 millisecond to about 10 seconds.

BRIEF DESCRIPTION OF THE DRAWING

For a more complete understanding of this invention, reference should now be made to the embodiment illustrated in greater detail in the accompanying drawing and described below by way of examples of the invention. In the drawing is shown a schematic representation of a decomposition system including a converging-diverging nozzle which is suitable for performing one embodiment of the method of this invention for the rapid, low pressure hydropyrolysis of carbonaceous material.

It should be understood that the drawing is not necessarily to scale and that the embodiment therein is illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiment illustrated herein.

DETAILED DESCRIPTION OF THE DRAWING INCLUDING PREFERRED EMBODIMENTS

The present invention is concerned with recovering valuable liquid and gaseous products from solid carbonaceous materials. Suitable solid carbonaceous materials for use in the present invention include coal, char, tar sands, oil shale, uintaite and biomass. Preferably the carbonaceous material is coal. All of the various types of coal or coal-like substances can be employed. These include anthracite coal, bituminous coal, subbituminous coal, lignite, peat, and the like.

In the process of the present invention, the carbonaceous material employed as the feed is crushed to a particle size between about one micron and about one millimeter in diameter. The particle size of the solid is preferably less than about 300 microns in the largest dimension and is more preferably less than about 100 microns in the largest dimension in order to maximize particle surface area.

The crushed carbonaceous material is initially subjected to a pressure in the range of from about atmospheric to about 10,000 psia (680 atmospheres) at a temperature of from about ambient up to the decomposition temperature of the carbonaceous material, which for coal is typically at least about 500° F. (260° C.). This can be effected in any convenient conventional manner, for example, in a zone or in a stream of carrier gas entraining the carbonaceous material. Thereafter, if the carbonaceous material is in such a zone, it is then passed from the zone and entrained in a stream of the carrier gas. In either case, the stream of carbonaceous material in the carrier gas is transported pneumatically at substantially the aforesaid temperature and pressure to a reactor for conversion to liquids and gases.

The carrier gas can suitably be any gas or gaseous mixture which does not itself, or does not contain or supply any material which would, substantially interfere with the formation and recovery of the desired products from the process of this invention. Gases which are suitable for use as the carrier gas comprise nitrogen, hydrogen, methane, ethane, propane, ammonia, water, methanol, hydrogen sulfide or the inert gases such as helium or argon.

Ideally the minimum amount of carrier gas that is necessary for effective transport is employed, in order to minimize the volume of carrier gas that must be compressed, heated, cooled, recovered and recycled for the pneumatic transport process. For example, when hydrogen is the carrier gas, the weight ratio of carbonaceous material to carrier gas in the stream is in the range of from about 0.25 to about 200. To further minimize the volume of hydrogen, the weight ratio of carbonaceous material to hydrogen in the stream is preferably at least 20 and more preferably at least 50. When the carrier gas is other than hydrogen, the weight ratio of carbonaceous material to carrier gas will differ from these values and depends generally on parameters such as the carrier gas density and the density and particle size of the carbonaceous material.

Preferably, prior to its introduction to the reactor, the carbonaceous material is pretreated with a material which, under the temperature and pressure conditions in the reactor, reacts with volatile products of the decomposition of the carbonaceous material in the reactor to stabilize such products against undesired recombination or further decomposition reactions.

The purpose of the pretreatment is to promote intimate contact of the external and, if any, internal surfaces of the carbonaceous material with the stabilizing material and, if possible, solubility of the stabilizing material in the carbonaceous material, prior to the thermal decomposition of the carbonaceous material. Providing that the intimate contact between the surfaces of the carbonaceous material and stabilizing material and/or solubility of the stabilizing material in the carbonaceous material is substantially maintained until decomposition of the carbonaceous material commences in the reactor, stabilizing material will be immediately accessible at the external surfaces and in the pores, if any, of the carbonaceous material, to stabilize the free radical polymerization precursors as they are produced, and hence to prevent polymerization.

Preferably the stabilizing material is hydrogen or a gaseous mixture containing hydrogen. In the alternative, a pretreatment material can be employed which does not itself react to stabilize the decomposition products in the reactor but which reacts in the reactor to yield a suitable stabilizing material. Such alternative pretreatment material is hereinafter referred to as a source of stabilizing material. If the stabilizing material is hydrogen, any material such as methane, ethane, propane, ammonia, water or methanol which has a hydrogen-to-carbon ratio greater than one and greater than the corresponding ratio for the carbonaceous material can be used as a source of hydrogen stabilizing material. Of course, the material containing or supplying the stabilizing material must not contain or supply any other material which would interfere substantially with the formation and recovery of the desired products under the operating conditions in the reactor.

The pressure of the stabilizing material or the source thereof employed in the pretreatment step is in the range of from about atmospheric to about 10,000 psia (680 atmospheres). In order to maximize adsorption of the stabilizing material on the surfaces of the carbonaceous particles, the pressure of stabilizing material or the source thereof is preferably at least 1000 psia (68 atmospheres) and more preferably at least 2000 psia (136 atmospheres). The temperature of the pretreatment operation must be sufficiently low so as not to effect undesirable decomposition or any undesirable reaction of or between the carbonaceous material and the stabilizing material. Generally, the pretreatment temperature is in the range of from about −100° F. (−73° C.). up to the decomposition temperature of the carbonaceous material, which for coal is typically at least about 500° F. (260° C.). If the carbonaceous material is a porous solid like coal, it is especially preferred that the temperature of the pretreatment operation is relatively low within the above range and that the pressure of the pretreatment operation is relatively high within the above range, in order to minimize the molar volume of the pretreatment gas and thus to maximize the amount of pretreatment gas that can be forced into the pores, and adsorbed on the surface, of the carbonaceous material. The duration of the pretreatment step is preferably less than about 24 hours, more preferably less than about 1 hour, because greater durations do not appear in our studies to afford added benefits.

Any convenient and conventional method can be used to effect and maximize intimate contact between the pretreatment material and the carbonaceous material. For example, the intimate contacting of the carbonaceous material with the stabilizing material or a source thereof could be achieved in the stream of carbonaceous material. In such case, the stabilizing material or a source thereof could be the carrier gas or a component thereof. In the alternative or in addition, the intimate contact could be effected in a zone into which the carbonaceous material is loaded and from which the carbonaceous material is passed and entrained in the stream of carrier gas for pneumatic transport to the reactor. In such case, the zone is conveniently maintained at a pressure which need only be sufficiently greater than the pressure in the stream of carbonaceous material so that carbonaceous material will pass from the zone to the stream of carbonaceous material.

One suitable scheme for carrying out the process of the present invention is illustrated schematically in the drawing. In operation, the pretreatment zone 12 is loaded batchwise with the carbonaceous material, next is closed to the atmosphere and then is pressurized with the pretreatment material entering via line 13 and valve 14 from the gas supply 15. For the purposes of this illustration, the pretreatment material is hydrogen. When the desired pressure is attained in the zone 12, the valve 14 can be closed. Provision can also be made for circulation of pretreatment material through the zone 12 and for the flow of pretreatment material to be such that the carbonaceous materials are stagnant or fluidized.

Preferably, prior to pretreatment of the carbonaceous material, volatile contaminants are removed from the carbonaceous material by treatment at a reduced pressure of from about 0.01 psia. ($6.8\times10^{-4}$ atmosphere) to about 10 psia. (0.68 atmospheres) and at an elevated temperature less than the decomposition temperature of the carbonaceous material.

When the carbonaceous material has soaked in the pretreatment gas for sufficiently long, a stream of carbonaceous material and pretreatment material is passed to a decomposition reactor by means of pneumatic transport. In the scheme illustrated in the drawing, the pretreatment inlet valve 14 and the outlet valve 18 are opened, permitting a stream of the pretreated carbonaceous material entrained in hydrogen to be withdrawn from the pretreatment zone 12 and to enter the line 19 to be transported therein pneumatically to the reactor 21. The pressure drop across the valve 18 need be no greater than that necessary to effect passage of carbonaceous material from the zone 12 to the line 19. If desired, additional entraining gas can be introduced into the stream of carbonaceous material via line 22 and valve 23. The empty volume in the pretreatment zone 12 created by the pneumatic transport therefrom of the stream of carbonaceous material leaving is filled by incoming hydrogen at the system pressure so that when all the carbonaceous material has been removed therefrom, the pretreatment zone 12 will be filled with hydrogen at the system pressure. The pretreatment zone 12 can then be vented, and preferably the hydrogen from the zone 12 can be recycled by means of a valve system (not shown) and refilled with carbonaceous material and the cycle repeated.

Preferably at least two pretreatment zones are employed so that they can be filled, pressurized, emptied and depressurized alternately. It should be noted that with suitable high-pressure, continuous, coal feeding technology, this entire pretreatment process can easily be made continuous.

The pressure on the stream of carbonaceous material is then reduced substantially in a single step to a pressure of from about sub-atmospheric to about 4000 psia. (272 atmospheres). Preferably, the pressure on the stream of carbonaceous materials is reduced to the more convenient and economical operating pressure of from about 1 psia. (0.068 atmosphere) to about 1000 psia. (68 atmospheres). The primary purpose of pressure reduction in substantially a single step is to accelerate the stream to the high velocities necessary to propel the entrained carbonaceous material into and through the reactor in short times and thereby to limit the time during which the carbonaceous material and its decomposition products are subjected to decomposition conditions in the reactor. In order to effect the pressure drop in substantially a single step and thus the maximum acceleration for a given total pressure drop, it is important to concentrate the total pressure drop in one restricted area, such as at the throat portion or at most over the converging and throat portions of the converging-diverging nozzle 24 shown in the drawing, along the path of the stream of carbonaceous material so that the pressure drop and concurrent acceleration at the restricted area approach nearly the same values as the total pressure drop and total acceleration, respectively. For example, the shape of the conduit 19 upstream of the restriction of converging-diverging nozzle 24 must be such as to minimize the pressure drop upstream of the restriction and to concentrate the pressure drop and the acceleration of the fluid at the throat of the nozzle 24. The converging portion of the restriction in the flow path of the stream of carbonaceous material makes it possible in essence to dam up the pressure drop within the restriction and upstream of the throat of the nozzle so that expansion and acceleration of the carrier gas are both concentrated within that region as opposed to a flow path of uniform cross-sectional shape and area wherein the total expansion and acceleration are distributed over a relatively greater length.

Generally, the greater the pressure drop the greater is the velocity to which the carbonaceous material is accelerated, until sonic velocity is reached, at which point a higher pressure drop will produce no further increase in the velocity. A substantially stepwise pressure drop equivalent to a ratio of the pressure upstream of the restriction to the pressure downstream of the restriction of at least 1.6 is sufficient to achieve the necessary acceleration and velocity through the reactor. However, it is preferable for this ratio to be at least about 2 to ensure that the stream of carbonaceous material is accelerated to at least a substantially sonic velocity.

By the term "sonic velocity" is meant the velocity achieved at the section of minimum cross-sectional area in the aforesaid restriction, when further reduction of the pressure downstream of the restriction, relative to a particular pressure upstream of the restriction, produces no further increase in the velocity and weight rate of flow through the restriction. The sonic velocity depends upon conditions such as temperature, ratio of carbonaceous material to entraining gas, the nature of the entraining gas, the molecular weight and heat capacities at constant pressure and at constant volume, the heat capacity of the carbonaceous material, the volume fraction of carrier gas occupied by the carbonaceous material, etc. In general, sonic velocity is not reached unless the ratio of the pressure upstream of the restriction to the pressure downstream of the restriction is in the range of from about 1.6 to about 2.0.

It will be understood from the foregoing that the sonic velocity is correlated with the maximum weight rate of flow through a given restricted area or orifice under given upstream conditions of temperature and the like. Thus acceleration of the stream of carbonaceous material to at least a sonic velocity permits the maximum throughput of carbonaceous material in the reactor. Further, so long as the pressure drop at the restriction is maintained at at least the minimum level required for sonic velocity, the downstream pressure can be varied independently of the upstream pressure. This permits considerable latitude in setting the conditions in the reactor.

While it is not clear, another advantage is believed to be that acceleration of the stream of carbonaceous material passing through the restriction and into the reactor to at least a sonic velocity may facilitate disintegration or shattering of the carbonaceous material as it is simultaneously heated very rapidly to at least the decomposition temperature of the carbonaceous material in the reactor. This disintegration or shattering at the restricted area may possibly be explosive in nature, being brought about by rapid expansion of compressed gas permeating the carbonaceous material or adsorbed thereby. The internal expansion of entrapped gas and of volatile reaction products as the temperature is raised and the pressure lowered should tend to "explode" the carbonaceous material, facilitating the escape of liquefaction products from the carbonaceous material and maximizing the surface which is exposed to the reaction environment. The tendency of the carbonaceous material to disrupt or shatter will be greater if gases are present within it which can evolve as the pressure drops. The rapid expansion of the gas would aid the shattering or disruption of the carbonaceous material into smaller fragments, which can react more rapidly to the desired products. The disintegration or shattering may possibly also be brought about by impact and/or attrition as the carbonaceous material passes through the restriction at accelerated velocity. Moreover, the disintegration or shattering may be due to both of these two actions. In any event, the disintegration or shattering is correlated with the rapid pressure drop and the concurrent rapid acceleration brought about when the entrainment of the carbonaceous material in the entraining gas passes through the restriction.

The sonic velocity can be calculated from experimentally measurable data by methods known in the art. The sonic velocity, however, cannot ordinarily be measured directly. Nor is it necessary to calculate, or to determine experimentally, the exact location where sonic velocity is reached. Nevertheless, the fact that sonic velocity is reached at least momentarily and the methods for establishing the magnitude of the sonic velocity are generally accepted by those skilled in pneumatics.

It is necessary to make a distinction between the velocity reached at the aforesaid section of minimum cross-sectional area in the restriction and the velocity downstream thereof. In general, the fluid may be decelerated or accelerated from the velocity reached at the section of minimum cross-sectional area in the restriction. Acceleration is brought about by further reduction of the pressure downstream of the restriction or by appropriate shaping of the conduit into which discharge downstream from the restriction is effected. For example, for acceleration to supersonic velocity, discharge at sonic velocity can be made from the restriction into a flaring conduit such as the divergent portion of a convergent-divergent nozzle. However, whether deceleration or acceleration is effected after sonic velocity has been reached at the restriction, the weight rate of flow through the restriction remains constant.

The shape and cross-sectional area of the restriction must be such as to allow free passage therethrough of the carbonaceous material. Several types of configurations can be used to expand at the restriction from a high pressure region to a low pressure region. Specific nozzle geometry is a critical factor in the design and can have an important impact on the discharge pattern and other fluid dynamic phenomena. Preferably a convergent or convergent-divergent nozzle 24 is employed. Velocities up to the sonic level can be attained at the throat of either a converging nozzle or the converging-diverging nozzle 24 illustrated in the drawing but supersonic velocities can be attained only in the diverging region downstream of the throat of a converging-diverging nozzle.

The materials from which the restriction is constructed must be carefully selected due to the abrasive nature of the carbonaceous material. Severe erosion problems could result in the high velocity portion of the restriction if relatively soft construction materials are employed. Construction materials with superior hardness and wear resistance such as carbided steel, etc., are preferred for this type of application.

The accelerated and expanded stream of carbonaceous material discharges from the restriction into the reactor where it is heated rapidly by heat exchange with hot gases therein, to a temperature at which decomposition of the carbonaceous material proceeds rapidly. In the reaction zone, the temperature of the stream of carbonaceous material is raised to at least its decomposition temperature, which for coal is typically at least about 500° F. (260° C.) to about 4000° F. (2204° C.). In order to increase the rate of decomposition, this temperature is preferably at least about 900° F. (482° C.) and more preferably at least about 1200° F. (649° C.). In order to increase the yield of liquid products relative to the yield of gaseous products, it is preferred that the temperature of the stream of carbonaceous material is raised to at most 3000° F. (1649° C.). The temperature and volume of hot gases in the reactor relative to the temperature and volume of the stream discharging from the restriction into the reactor are sufficient to permit heat transfer to the carbonaceous material at a rate of from about 500° F. (260° C.) per second to about $5\times10^{6}$° F. ($2.78\times10^{6}$° C.) per second, to raise the temperature of the stream of carbonaceous material to the desired level. Typically the hot gas in the reactor is introduced into the reactor at a temperature of between 650° F. (343.5° C.) and 5000° F. (2,760° C.)

In the embodiment illustrated in the drawing, the hot gas is introduced into the reactor through the addition ports 25, 25'. It is not necessary for the streams of hot gas to impinge upon the accelerated and expanded stream of carbonaceous material, in order to achieve the required mixing and heat exchange with the carbonaceous material. Adequate mixing and heat exchange can be effected by aspiration of the hot gases into the accelerated stream of carbonaceous material. This aspiration effect is due to the conservation of momentum of the accelerated stream of carbonaceous material entering the reactor, resulting in heat transfer from the hot gas to the carbonaceous material at the desired rates. Thus, the acceleration of the stream of carbonaceous material to a high velocity at the restriction serves the additional important function of promoting a rapid temperature rise of the carbonaceous material in the reactor. Of course, any convenient means for mixing the hot gas with the stream of carbonaceous material can be employed.

In order to achieve the desired aspiration effect, it is essential to employ fluid dynamics such that the carbonaceous materials and decomposition products therefrom are permitted to expand as a free jet in the reactor. The reaction mixture is permitted to expand as a free jet in a configuration in which the width of the reactor 21 is substantially greater than the diameter of the restriction from which the carbonaceous material discharges into the reactor. This can be achieved by employing a reactor having a width which is at least about 50 times, preferably at least 100 times and more preferably at least 200 times, greater than the diameter of the restriction. Such a configuration also minimizes contact of the partially fused materials with the walls of the reactor and hence reduces plugging problems.

Suitable hot gases for mixing with the incoming stream of carbonaceous material include hydrogen, carbon monoxide, carbon dioxide, nitrogen, hydrocarbon gases or a recycle gas from the reactor. This gas can be heated by any convenient conventional method to the desired temperature. Preferably the gas is heated prior to entering the reactor. Suitably the gas can be heated by heat generated by the formation or reaction of the gas. For example, carbon monoxide and carbon dioxide can be obtained by the combustion of char in air or oxygen and can be heated by the heat of this combustion. Moreover, hydrogen can be heated by the heat from the reaction of excess hydrogen with oxygen. As indicated in the drawing hydrogen from the hydrogen supply 15 is conducted to a combustion reactor 27 via the conduit 28 and valve 29. Oxygen is also introduced into the combustion reactor 27 from the oxygen source 30 via the conduit 31 and valve 32. Sufficient hydrogen is introduced into the combustion reactor 27 to react with all of the oxygen introduced thereinto, leaving an excess of hydrogen which flows in line 33 to the reactor 21 and which is sufficient for the hydrogen to serve as an effective heat transfer agent in the reactor 21. While combustion of hydrogen and oxygen is illustrated in the drawing as occurring external to the reactor 21, which is preferred, the combustion of hydrogen and oxygen could also occur inside the reactor 21.

It is essential that the reaction mixture in the reactor 21 be quenched rapidly to reduce the temperature and stop further reaction, if the time during which this mixture is exposed to decomposition conditions is to be short and precisely controlled. Any suitable conventional quenching technique can be used. One suitable quenching technique involves directly contacting the hot reaction mixture with a relatively cool quench material. This can suitably be done by direct injection of a relatively cool fluid into the reaction mixture, as shown in the drawing, through the ports 34, 34'. Quenching could also occur by introducing the reaction mixture into a quench material which may be stagnant or flowing in a stream. In addition, quenching can be effected by indirect heat exchange to heat exchangers placed in the path of the reaction mixture. The quench can also take place in a separate zone within the reaction vessel or in a separate vessel, but the latter approach may hinder the attainment of the shortest possible residence times.

The quench material can be, broadly, any of a wide variety of gases or liquids that can be combined quickly with the reactant mixture in order to cool the mixture below the effective decomposition temperature while the mixture is in the reactor. Examples of suitable quenching gases include nitrogen, inert gases such as helium or argon, hydrogen, carbon dioxide, steam and gaseous products recycled from the method of this invention. Examples of suitable quenching liquids include water, oil, coal-derived liquids or resids. It is also possible to use as the quenching medium a relatively heavy liquid hydrocarbon product, such as a recycled product from the method of this invention, and to use the sensible heat of the reaction mixture leaving the reaction zone to crack the heavy liquid product to lighter, more valuable liquids. Although some suitable quench materials can react at the temperatures found in the reactor, it is understood that these materials can be added to the reaction mixture, at such a temperature and in such volume that the result is primarily a quenching of the reaction mixture, rather than additional reaction between the reaction mixture and the quenching material. Nevertheless, reactions which do not introduce undesirable products into the reaction mixture or remove desirable products from the reaction mixture are tolerable.

The temperature and the amount of quenching material added must be sufficient to quench the reaction mixture rapidly. The weight ratio of quench material to reaction mixture is dependent upon such factors as the temperature and components of the reaction mixture and other conditions. Quenching is a function of the sensible heat in the reaction mixture and in the quench stream. Depending upon the temperature and mass flow of the reaction mixture through the reactor, a sufficient amount of quenching material, at a suitable temperature, should be added to the reaction mixture so that the temperature of the reaction mixture is lowered to less than 500° F. (260° C.) Preferably the temperature of carbonaceous material in the reaction zone is at least 900° F. (482° C.) and is quenched to below 900° F. (482° C.). More preferably the temperature of carbonaceous material in the reaction zone is at least 1200° F. (649° C.) and is quenched to below 1200° F. (649° C.). The temperature and amount of quench material that is combined with the reaction mixture must be sufficient to lower the temperature of the reaction mixture at a rate of from about 500° F. (260° C.) per second, preferably from about $5\times10^{6}$° F. ($2.78\times10^{6}$° C.) per second. Under these conditions, the total time required for introduction, heat-up and decomposition of the carbonaceous material and quench of the resulting reaction mixture can be limited to between 1 millisecond and 10 seconds.

The quenched reaction mixture can then be collected and separated into its solid, liquid and gaseous components by any suitable conventional methods.

EXAMPLE 1

In one specific illustration, a cylindrical reactor vessel is employed which has an inside diameter of 6 inches (15.24 centimeters) and a vertical axis. The reactor vessel is open at its bottom and closed at its top except for a converging nozzle located at its vertical axis and for 2 inlets for hot hydrogen. The hot hydrogen introduced to the reactor vessel at a combined rate of 1,000–1,500 standard cubic feet (28.32–42.48 standard cubic meters) per hour is preheated by the heat from the combustion of hydrogen and oxygen where it raises the temperature in the upper or reaction zone of the reactor vessel to 1,650° F. (899° C.). The reaction zone is maintained at a pressure of 45 psia. (3.06 atmospheres).

The inlet portion of the nozzle converges from an inside diameter of 0.203 inch (0.512 centimeter) to a diameter of 0.04 inch (0.10 centimeter) at the throat, over a length of 2.5 inches (6.35 centimeters). The throat portion of the nozzle is 0.16 inch (0.41 centimeter) in length.

Three ports for introduction of quench water are located 16 inches (40.6 centimeters) below the nozzle at the wall of the reactor vessel and are equally spaced from one another. Water at ambient temperature from the ports at a combined rate of 0.75 gallon (2.84 liters) per minute impinges upon the reaction mixture moving downward in the reactor vessel and cools the reaction mixture at this point in the reactor to 215° F. (102° C.). Thus the reaction zone is confined to the upper 16 inches (40.6 centimeters) of the reactor vessel.

A stream containing crushed western coal particles up to 150 microns in the largest dimension entrained in hydrogen is introduced downward into the reactor through the nozzle. In the stream, the coal feed rate is 31 pounds (14.1 kilograms) per hour; the hydrogen feed rate is 160 standard cubic feet (4.53 standard cubic meters) per hour and the weight ratio of coal to hydrogen is 35. The temperature and pressure of the stream upstream of the nozzle are 70° F. (21.1° C.) and 118 psia (5.03 atmospheres), respectively. The residence time of the reaction mixture in the reaction zone of the reactor vessel is calculated to be 2–5 milliseconds.

The solids and liquids in the quenched reaction mixture exiting the bottom of the reactor vessel are collected in a receiver. The gaseous products are filtered through charcoal to remove entrained liquids which are then combined with the liquid products in the receiver. Thereafter the yields of char, liquid and gaseous products are measured and the gaseous products are analyzed. The yields measured as weight percent of carbon in the coal are indicated in the Table hereinbelow.

TABLE

| Product | Yield |
|---|---|
| liquid | 28.1 |
| gas, total | 4.5 |
| carbon dioxide | 0.3 |
| methane | 1.9 |
| ethane | 0.3 |
| ethylene | 1.5 |
| propane | 0.5 |
| char | 67.4 |

From the above description, it is apparent that the objects of the present invention have been achieved. While only certain embodiments have been set forth, alternative embodiments and various modifications will be apparent from the above description to those skilled in the art. These and other materials are considered equivalents within the spirit and scope of the present invention.

Having described the invention, what is claimed is:

1. A process for treating crushed solid carbonaceous material to obtain therefrom liquid and gaseous products, comprising:

subjecting the carbonaceous material in a stream of carrier gas to a first pressure in the range of from about 1 atmosphere to about 680 atmospheres, at a first temperature of from about ambient up to the decomposition temperature of the carbonaceous material, the carbonaceous material having a particle size in the range of from about 1 micron up to about 1 millimeter in the largest dimension;

reducing substantially in a single step the pressure on the stream of carbonaceous material from the first pressure to a second pressure in the range of from about sub-atmospheric to about 272 atmospheres, the ratio of the first pressure to the second pressure being at least about 1.6, thereby accelerating the carrier gas in the stream of carbonaceous material to at least a sonic velocity;

permitting the accelerated stream of carbonaceous material to expand as a free jet and mixing hot gas with the accelerated and expanded stream of carbonaceous material to raise the temperature of the carbonaceous material by heat exchange with the hot gas, to a second temperature in the range of the decomposition temperature to about 2204° C., and thereby initiating decomposition of the carbonaceous material to form a reaction mixture containing liquids and gases; and reducing the temperature of the reaction mixture to below the decomposition temperature, with the total time for heating the carbonaceous material from the first temperature to the second temperature, decomposing the carbonaceous material and cooling the reaction mixture to below the decomposition temperature being in the range of from about 1 millisecond to about 10 seconds.

2. The process of claim 1 wherein the carbonaceous material is intimately contacted at the first temperature and the first pressure either with a material which at the second temperature and at the second pressure reacts with products from the decomposition to stabilize the decomposition products against recombination or further decomposition reactions, or with a material which produces the stabilizing material at the second temperature and second pressure, and wherein the carbonaceous material is transported in intimate contact with the stabilizing material or said producing material in the stream of carrier gas.

3. The process of claim 2 wherein the stabilizing material or the producing material is a component of the carrier gas in said stream.

4. The process of claim 2 wherein the carbonaceous material is subjected to a pretreatment of intimate contact with the stabilizing material or the producing material in the gaseous state at a pressure in excess of the first pressure and then the carbonaceous material, in intimate contact with the stabilizing material or the producing material, is entrained at the first pressure and at the first temperature in the stream of carrier gas.

5. The process of claim 4 wherein the stabilizing material or the producing material is additionally a component of the carrier gas in the stream.

6. The process of claim 2 wherein the stabilizing material includes hydrogen and the producing material is a gas which at the second temperature and second pressure supplies hydrogen and has a ratio of hydrogen atoms to carbon atoms greater than one and greater than the corresponding ratio for the carbonaceous material.

7. The process of claim 6 wherein the producing material is methane.

8. The process of claim 4 wherein, prior to being pretreated, the carbonaceous material is subjected to an elevated temperature less than the decomposition temperature of the carbonaceous material and at a pressure of from about $6.8\times10^{-4}$ atmosphere to about 0.068 atmosphere.

9. The process of claim 1 wherein the carbonaceous material is coal.

10. The process of claim 1 wherein the carrier gas is hydrogen.

11. The process of claim 1 wherein the weight ratio of carbonaceous material to carrier gas in the stream being equivalent to a corresponding ratio of from about 0.25 to about 200 when the carrier gas is hydrogen.

12. The process of claim 1 wherein the second pressure is in the range of from about 0.068 atmosphere to about 68 atmospheres.

13. The process of claim 1 wherein the ratio of the first pressure to the second pressure is at least 2.

14. The process of claim 1 wherein the second temperature is at least 482° C. and is reduced to a temperature below about 482° C.

15. The process of claim 14 wherein the second temperature is at least 649° C. and is reduced to a temperature below about 649° C.

16. The process of claim 1 wherein the hot gas is hydrogen or a gas resulting from the combustion of char.

17. The process of claim 1 wherein the mixing of the hot gas and the stream of carbonaceous material is effected by aspirating the hot gas into the stream of carbonaceous material.

18. The process of claim 1 wherein the total time is in the range of from about 2 milliseconds to about 50 milliseconds.

19. The process of claim 4 wherein the carbonaceous material is coal, the second temperature is at least 482° C. and is reduced to a temperature below about 482° C., the second pressure is in the range of from about 0.068 atmosphere to about 68 atmospheres, and the stabilizing material is hydrogen.

20. The process of claim 1 wherein the carbonaceous material is tar sands.

21. The process of claim 1 wherein the carbonaceous material is oil shale.

22. The process of claim 1 wherein the carbonaceous material is biomass.

* * * * *